US006691869B2

(12) United States Patent
Knaack et al.

(10) Patent No.: US 6,691,869 B2
(45) Date of Patent: Feb. 17, 2004

(54) FOLDING BOX WITH INNER BASE OFFSET TO THE INSIDE OF THE BOX

(75) Inventors: Holger Knaack, Hamburg (DE); Klaus-Peter Stange, Wentorf (DE); Günther Schultz, Hamburg (DE)

(73) Assignee: Beiersdorf AG, Hamburg (DE)

( * ) Notice: Subject to any disclaimer, the term of this patent is extended or adjusted under 35 U.S.C. 154(b) by 0 days.

(21) Appl. No.: 09/943,032

(22) Filed: Aug. 30, 2001

(65) Prior Publication Data

US 2002/0036150 A1 Mar. 28, 2002

(30) Foreign Application Priority Data

Sep. 6, 2000 (DE) ..... 100 44 018

(51) Int. Cl.[7] ..... B65D 85/20; B65D 5/50; B65D 79/00; B65D 73/00

(52) U.S. Cl. ..... 206/446; 206/756; 206/751; 206/489

(58) Field of Search ..... 206/446, 775, 206/776, 756, 769, 770, 771, 427, 581, 505, 509, 515, 520, 777, 751, 752, 753, 754, 755, 759, 760, 489, 784, 592; 229/104, 915, 183

(56) References Cited

U.S. PATENT DOCUMENTS

| | | | | |
|---|---|---|---|---|
| 1,811,074 A | * | 6/1931 | Butler | 229/104 |
| 2,114,422 A | | 4/1938 | Guyer | 229/39 |
| 2,744,622 A | * | 5/1956 | Sparks | 206/777 |
| 4,236,662 A | | 12/1980 | Roccaforte | 229/39 |
| 5,240,176 A | * | 8/1993 | Akers | 229/155 |

FOREIGN PATENT DOCUMENTS

| | | | |
|---|---|---|---|
| DE | 94 19 312 | 3/1995 | B65D/5/50 |
| DE | 298 09 003 | 9/1998 | B65D/5/06 |
| EP | 0 732 269 | 9/1996 | B65D/5/50 |
| EP | 0 642 977 | 12/1996 | |
| EP | 0 761 550 | 3/1997 | B65D/5/50 |
| EP | 0 699 588 | 10/1998 | |
| FR | 2 731 682 | 9/1996 | B65D/77/04 |
| FR | 2 744 985 | 8/1997 | B65D/5/50 |
| GB | 2 293 814 | 4/1996 | B65D/5/50 |

* cited by examiner

*Primary Examiner*—Mickey Yu
*Assistant Examiner*—John G Pickett
(74) *Attorney, Agent, or Firm*—Norris McLaughlin & Marcus

(57) ABSTRACT

A folding box having a rectangular pack casing, a lid part which is connected on the border side of the pack casing and is provided with an insertion flap which engages in the pack casing, wherein articulated in the base region, on one of the four walls which form the pack casing, is a base part provided with an insertion flap which engages in the pack casing, there being articulated on the insertion flap an extension which forms an inner base and at least comprises an inner-base flap, which is articulated on the insertion flap, and an adhesive flap, which is articulated on the inner-base flap and, with the folding box in the completed state, is adhesively bonded to a first side wall, which is located opposite a second side wall, which is in contact with the insertion flap.

12 Claims, 12 Drawing Sheets

FOLDING BOX WITH INNER BASE OFFSET TO THE INSIDE OF THE BOX

Figure 1:
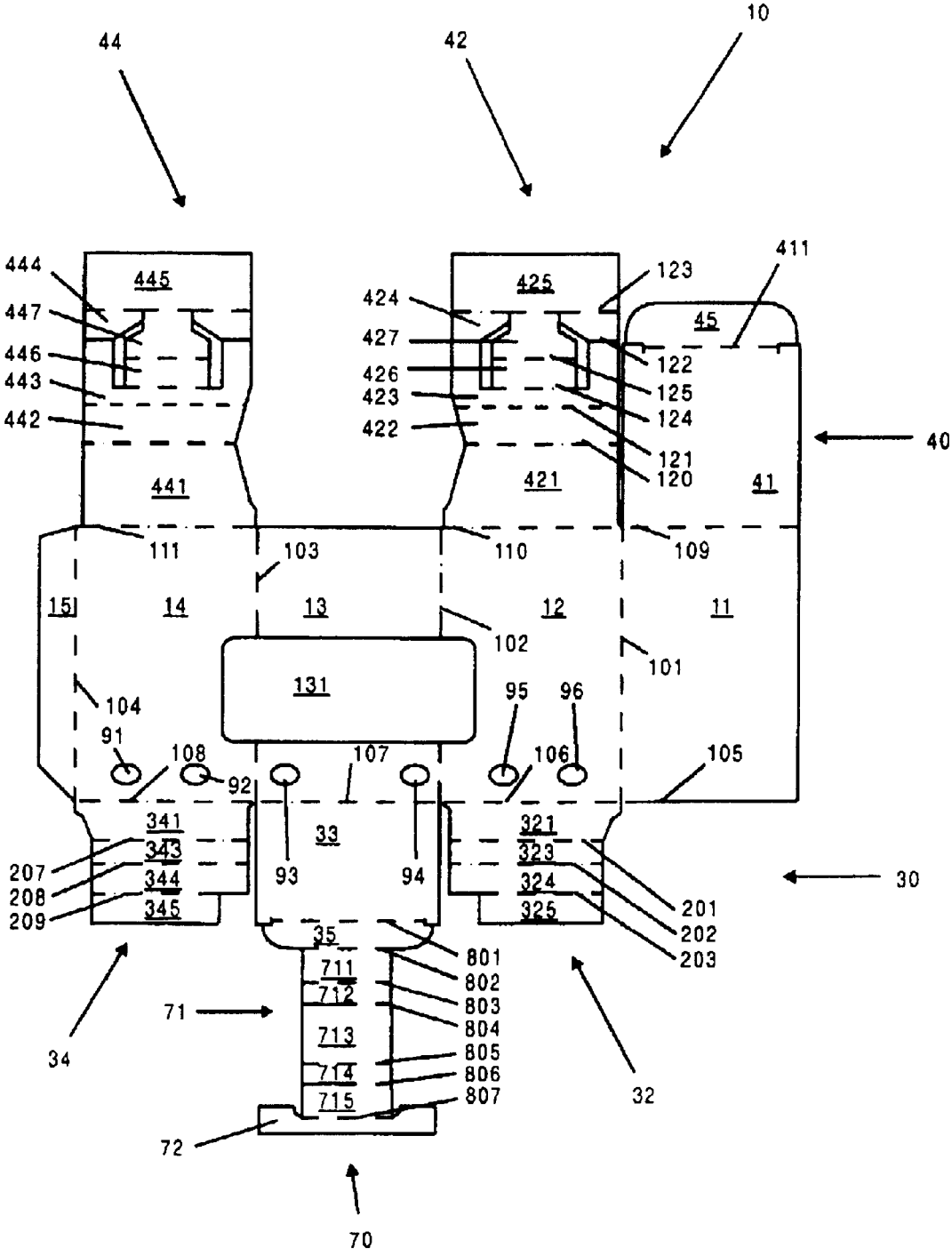

The invention relates to a folding box for goods such as glasses, bottles, jars or similar products, in particular for cosmetics articles, having a rectangular pack casing, having a lid part which is connected to the border side of said pack casing and is provided with an insertion flap which engages in the pack casing, and having an inner base offset to the inside of the box.

EP 0 699 588 A1 discloses a folding pack for goods such as glasses, bottles, jars or similar products which has a rectangular pack casing, a lid part which is connected to the border side of said pack casing and is provided with an insertion flap which engages in the pack casing, and a base part likewise provided with an insertion flap.

Connected to the two walls of the pack casing which are adjacent to the base part and/or the lid part within each case one deformable flap which has three folding lines which run parallel to the connection border on the pack casing and subdivide the deformable flap into four individual sections, the outer section being adhesively bonded to the inside of the pack casing.

This forms two carriers for accommodating the product which is to be protected in the pack, and of which the position is further strengthened by the provision of cutouts in the carriers which are adapted to the shape of the product. In the embodiment selected here, the base of the folding pack always terminates flush with the surface on which the folding pack stands. Arranging the base to be offset in the direction of the interior of the folding pack is not proposed, nor moreover, on account of the arrangement of the flaps, is it possible.

The disadvantage with the folding pack is, on the one hand, that the product located within the pack is not sufficiently protected and, on the other hand, that the stability of the base is not increased, precisely as is customary in the packaging sector.

EP 0 642 977 A1 discloses a similar box, which has at least one retaining and protective element for a glass. The box is formed by four successive main walls. Provided both in the lid region and in the base region are two conventional closure walls which can close the box in the known manner.

Articulated, furthermore, in the lid region are two dust flaps which, before the top closure wall is inserted into the pack body, are swung in and thus make it difficult for dirt and dust to penetrate.

Essential to the invention are two flaps which are provided in the base region and are divided up into a multiplicity of continuous individual sections. Folding said flaps produces within the box, a double-layered two-part carrier which is made up of the individual sections and is helpful for fixing the product and for displaying the same. Provided in the two carrier halves are cutaway portions, of which the shape and size are adapted to the product which is to be accommodated.

The object of the invention is to provide a reclosable cuboidal folding box which provides an inner base, which can be stacked and which provides sufficient protection to the product located within the folding box, which has a high level of stability with the smallest possible amount of material being used, which can be produced cost-effectively using the smallest possible amount of material, which can be easily and quickly erected, filled and closed with the aid of machines, and of which the folding blank is in a single piece.

This object on which the invention is based is achieved by the teaching of the main claim. Advantageous configurations are explained here in the subclaims. The invention also covers a punched blank of the folding box according to the invention.

Accordingly, the invention describes a folding box for goods such as glasses, bottles, jars or similar products, in particular for cosmetics articles, having a rectangular pack casing, and having a lid part which is connected to the border side of said pack casing and is provided with an insertion flap which engages in the pack casing.

Articulated in the base region, on one of the four side walls which together form the pack casing, is a base part provided with an insertion flap which engages in the pack casing. Articulated on the insertion flap is an extension which forms an inner base and at least comprises an inner-base flap, which is articulated on the insertion flap, and an adhesive flap which is articulated on the inner-base flap. With the folding box in the completed state, the adhesive flap is adhesively bonded to the side wall which is located opposite the side wall which is in contact with the insertion flap.

In a first advantageous embodiment, provided in the inner-base flap are four parallel folding lines which divide the inner-base flap into five individual sections, the resulting central section of the inner-base flap preferably being adhesively bonded to the base part in order to increase the stability of the base part further. Two sections in the inner-base flap then form the inner base, namely, on the one hand, the section which is articulated directly on the insertion flap and, on the other hand, the section which is articulated directly on the adhesive flap of the extension.

The length of the central section of the inner base flap by which said section rests, or is adhesively bonded, on the base part determines the size of the bearing surface by which the inner base is smaller than the surface area of the base part.

It is also preferred if the inner-base flap is narrower than the base part, that is to say if the inner-base flap does not extend over the entire width of the base part. This also results in the bearing surface for the product on the inner base being reduced, but does cut back on packaging material. The lower level of stability of the inner base is acceptable, in particular, for lighter products.

In a further preferred embodiment of the folding box, connected in an articulated manner, in the base region, to the two side walls of the pack casing which are adjacent to the base part is in each case one flap, said flaps having three folding lines which run parallel to the connection border on the pack casing and subdivide the flaps, as seen from the connection border, into a first spacer crosspiece, into a supporting strip, into a second spacer crosspiece and into an adhesive flap. The adhesive flap here is adhesively bonded to the inside of the pack casing such that the supporting strip and the second spacer crosspiece are aligned essentially at right angles to one another.

The two spacer crosspieces are preferably of the same, or of at least more or less the same, width.

In a further preferred embodiment of the folding box, the flaps are cut such that, with the folding box in the completed state, the flaps extend over the central section of the inner-base flap, said central section butting against the base part. This embodiment of the folding box is useful, in particular, when a high bearing surface, that is to say a large inner base, is necessary and, at the same time, the flaps are to be provided in order to protect against dust.

This is achieved if corresponding parts of the first spacer crosspiece and, in particular, of the supporting strip are cut out, with the result that the two sections in the inner-base flap project into the resulting gaps and largely fill said gaps in the bearing surface.

In the case of the flaps, three further flaps are also preferably articulated in each case on the adhesive flap via three folding lines running parallel to the connection border on the pack casing.

This lengthens the flaps, with the result that, during the task of folding up the flaps, additional folding can take place.

In order that crumpling of the cardboard in the region of the flaps is reliably prevented as the folding box is erected and closed, all the surfaces which follow the second spacer crosspiece may be tapered on both sides. They thus do not extend over the entire width of the side wall. This results in these surfaces being easy to fold in during the production of the folding box. It preferably also results in each case in the second spacer crosspiece being adhesively bonded to the outermost flap and, in order to maximize the stability overall, optionally also in the first spacer crosspiece being adhesively bonded in each case to the flap following the adhesive flap.

These adhesively bonded folded sections result in additional stiffening of the inner-base inserts in the base interior of the folding box without the folding box being adversely affected as it is erected, filled and closed.

In a further preferred embodiment of the folding box, connected in an articulated manner, in the lid region, to the two walls of the pack casing which are adjacent to the lid part is in each case one flap, said flap having three folding lines which run parallel to the connection border on the pack casing and subdivide the flap, as seen from the connection border, into a first spacer crosspiece, into a supporting strip, into a second spacer crosspiece and into an adhesive flap. The adhesive flap here is adhesively bonded to the inside of the pack casing such that the supporting strip and the second spacer crosspiece are aligned essentially at right angles to one another.

The two spacer crosspieces are preferably of the same, or of at least more or less the same, width.

The supporting strip and the second spacer crosspiece also preferably have a cutout which is provided for accommodating the product and is adapted to the shape of the latter. For example, the cutout maybe rectangular in the region of the supporting strip and be circle-arc-shaped or trapezoidal in the following, second spacer crosspiece.

Furthermore, the circle-arc-shaped or trapezoidal region of the cutout may extend as far as the folding line of the adhesive flap.

In a further preferred embodiment of the folding box, and in particular of the flap, in the case of the flaps, the adhesive flap is followed in each case by a third spacer crosspiece, via a folding line, and by a second adhesive flap, via a folding line. This achieves the situation where the walls of the flaps are at least partially of double-walled design, which further increases the stability of the flaps. This is advantageous, in particular, in the case of heavy products because bowing of the flaps is thus reliably prevented.

In the region of the flap, there may be provided a surface which has an increased coefficient of static and/or sliding friction and against which the product inserted into the folding box butts at least partially. In particular, the surface is formed, in certain regions, by a folding unit which is connected integrally to the adhesive flap and the supporting strip and has two folding lines which are spaced apart by a distance corresponding essentially to the width of the spacer crosspiece.

In order to improve the stacking capacity of the folding boxes, it has proven advantageous if at least two side walls of the folding box which form the pack casing taper slightly in the direction of the lid region starting from the base region, in which case the tapering side walls should be arranged opposite one another.

The reduction in the side-wall width applies particularly preferably to all four side walls.

In this way, the pack casing attains the form of a pyramid which has a preferably square base surface and of which the vertex has been removed, a so-called truncated pyramid. The inclination of the side walls preferably does not exceed 10°, but can also assume much higher values.

In a further preferred embodiment of the folding box, provided in a, in particular the front, side wall is a cutout which extends, in particular, into the adjacent side walls and is covered, in particular, by a transparent film.

It is thus easy to see the product located within the pack, with the result that an aesthetically pleasing product can attract more potential buyers.

Furthermore, the film prevents the penetration of dust and, at the same time, increases the stability, since the action of punching out the window in the folding box reduces the rigidity of the folding box. The adhesive bonding of the window film compensates for the reduction in the rigidity of the folding box.

Possible materials for the folding box are all suitable flexible materials, but in particular cardboard and paperboard.

The invention also covers at least one punched blank for producing a reclosable cuboidal folding box with a front side wall, a rear side wall, a right-hand side wall, which connects the front side wall and the rear side wall, and a left-hand side wall, a base closure, which is formed by three base-closure tabs, and a top closure, which is formed by three closure tabs, it being the case that the folding box comprises a folding blank made of paperboard, cardboard or some other suitable material, the front side wall, the rear side wall, the right-hand side wall, which connects the front side wall and the rear side wall, and the left-hand side wall as well as the flap, each linked to one another via folding lines, are arranged rectilinearly one behind the other in a row, articulated on the rear side wall, via the folding line, is a rectangular lid part which terminates, via the folding line, in an insertion flap which engages in the pack casing, the right-hand side wall has articulated on it, on the one hand, a flap via a folding line and, on the other hand, on the opposite side, a flap via a folding line, the flap being divided up into five individual sections, to be precise, starting from the folding line, into a first spacer crosspiece, into a crosspiece, into a supporting strip, into a second spacer crosspiece and into an adhesive flap, between which a total of four folding lines which are arranged parallel to the pack border are provided, the flap being subdivided by three folding lines running parallel to the connection border on the pack casing, as seen from the connection border, into a first spacer crosspiece, into a supporting strip, into a second spacer crosspiece and into an adhesive flap, articulated on the front side wall, in which there is provided, if appropriate, a cutout which extends into the adjacent side walls, is a base part provided with an insertion flap which engages in the pack casing, there being articulated in particular centrally on the insertion flap, via the folding line, an extension which comprises an inner-base flap, which is articulated on the insertion flap and in which there are provided four parallel folding lines which divide the inner-base flap into five individual sections, and an adhesive flap, which is articulated on the inner-base flap, the left-hand side wall has articulated on it, on the one hand, a flap via a folding line and, on the other hand, on the opposite side, a flap via a folding line, the flap being divided up into five individual sections, to be precise, starting from the folding line, into a first spacer crosspiece, into a crosspiece, into a supporting strip, into a second spacer crosspiece and into an adhesive flap, between which a total of four folding lines which are arranged parallel to the pack border are provided, the flap being subdivided by three folding lines running parallel to the connection border on the pack casing, as seen from the connection border, into a first spacer crosspiece, into a supporting strip, into a second spacer crosspiece and into an adhesive flap.

The folding box according to the invention has a second base, that is to say an inner base, in a preferred embodiment flaps in the lid region and in the base region which, on the one hand, avoid the penetration of dust into the folding box and, on the other hand, serve as fixing surfaces (supports) for the product which is to be stored within the folding box.

The fixing surfaces retain the product (in particular a jar with a screw lid) in a centered manner in the center of the folding box. These two supports incorporated in the flaps ensure that the product is fixed well.

The flaps in the lid region may have additional step-like recesses which are formed in accordance with the product.

These additional grips on the two lateral top regions of the product fix the product in the viewing window of the folding box, with the printing in a precise position, without subsequent shifting and turning being possible.

These additional fixing, adhesively bonded folded sections in the region of the supports may be adapted to the dimensions of the product. The inner base provides a platform-like elevation in the interior of the folding box. By virtue of these two prominent packaging components, the product is retained to good effect even when subjected to pronounced pressure or vibration. In conjunction with the cutaway window portion in the front bottom region of the folding box, the product is displayed in a clearly visible manner.

Flaps of straightforward configuration can also support the product. If alignment, with the printing in a precise position, in relation to the window of the folding box is to take place, additional adhesive bonding may be carried out, either on the flaps or on the inner-base surface.

This type of bonding achieves a high crumpling resistance. The product (in this case a jar) is thus reliably retained on its tray-like insert. Deformation of the drawn-in base can be ruled out.

Figure 2:
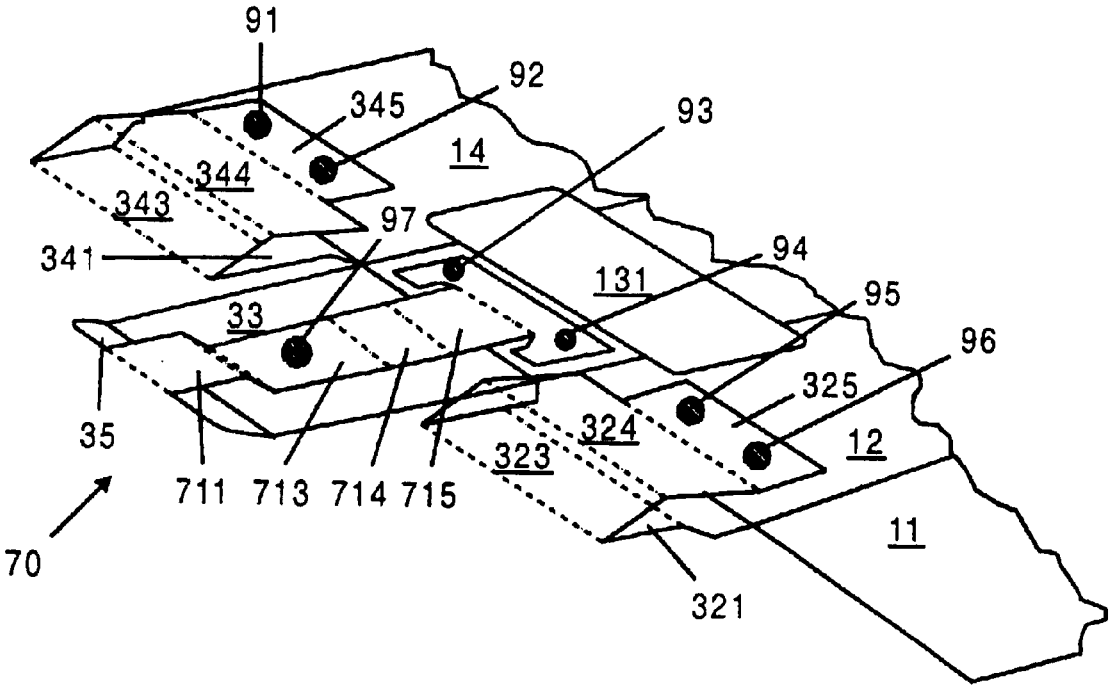
Figure 3:
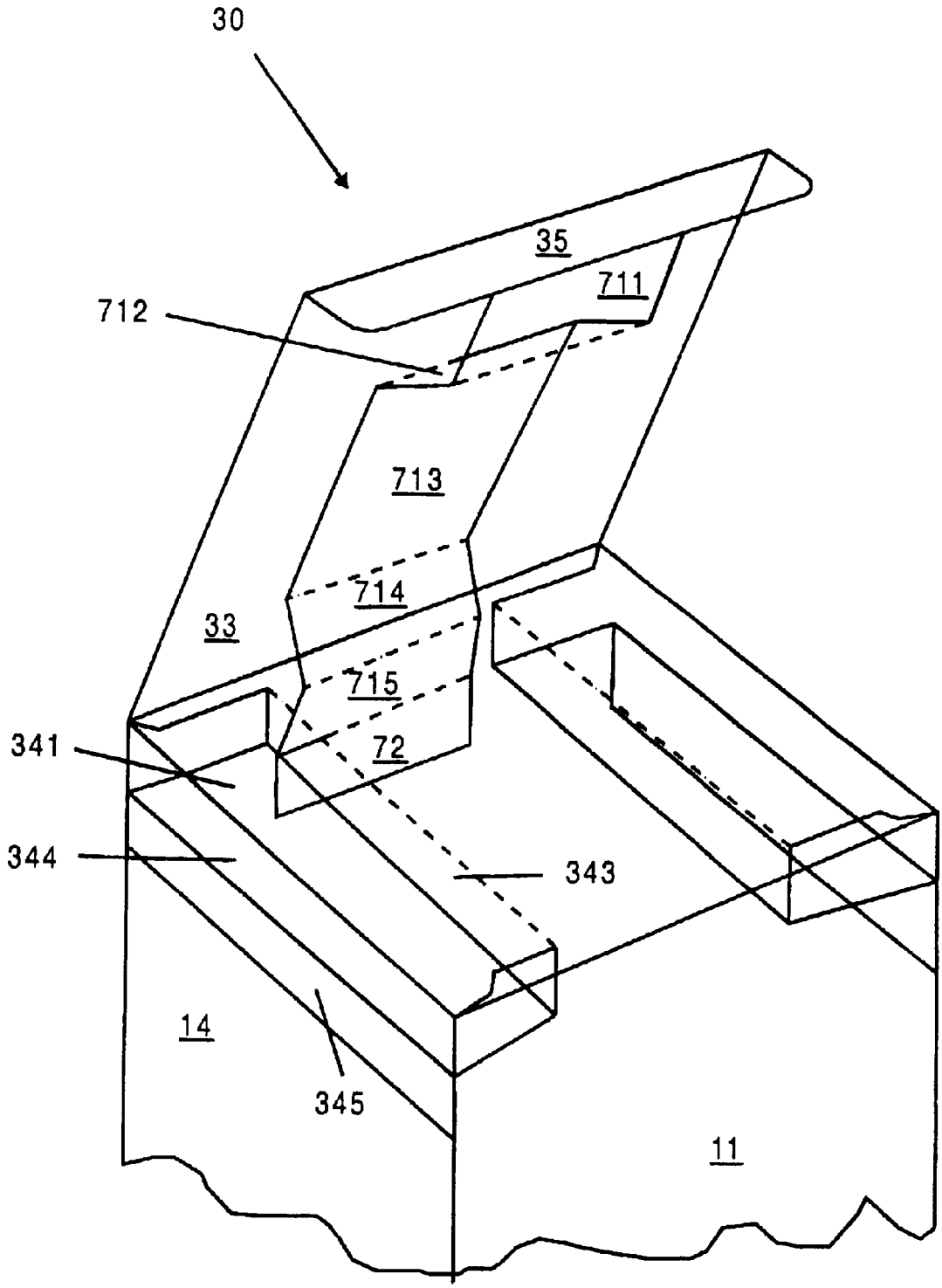
Figure 4:
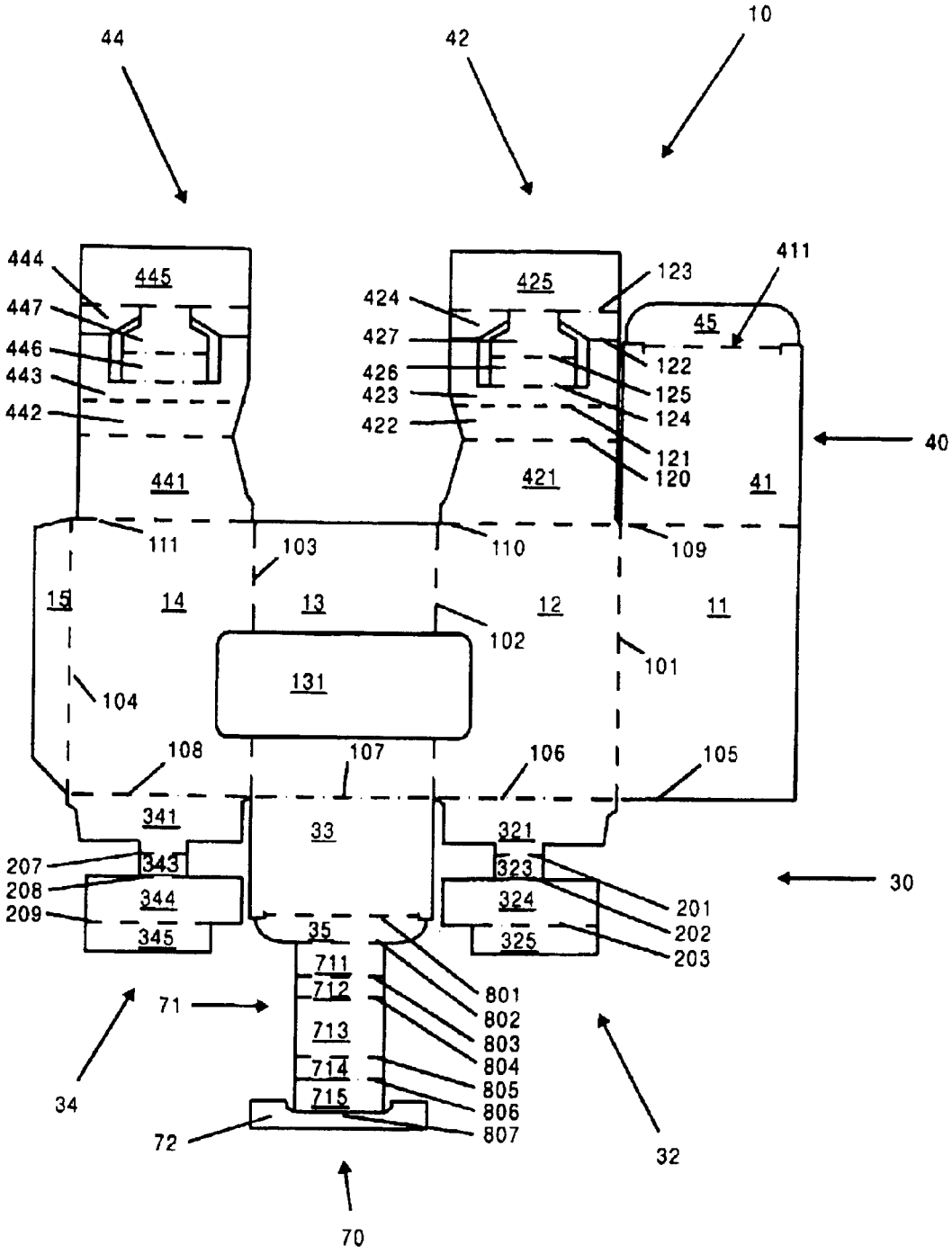
Figure 5:
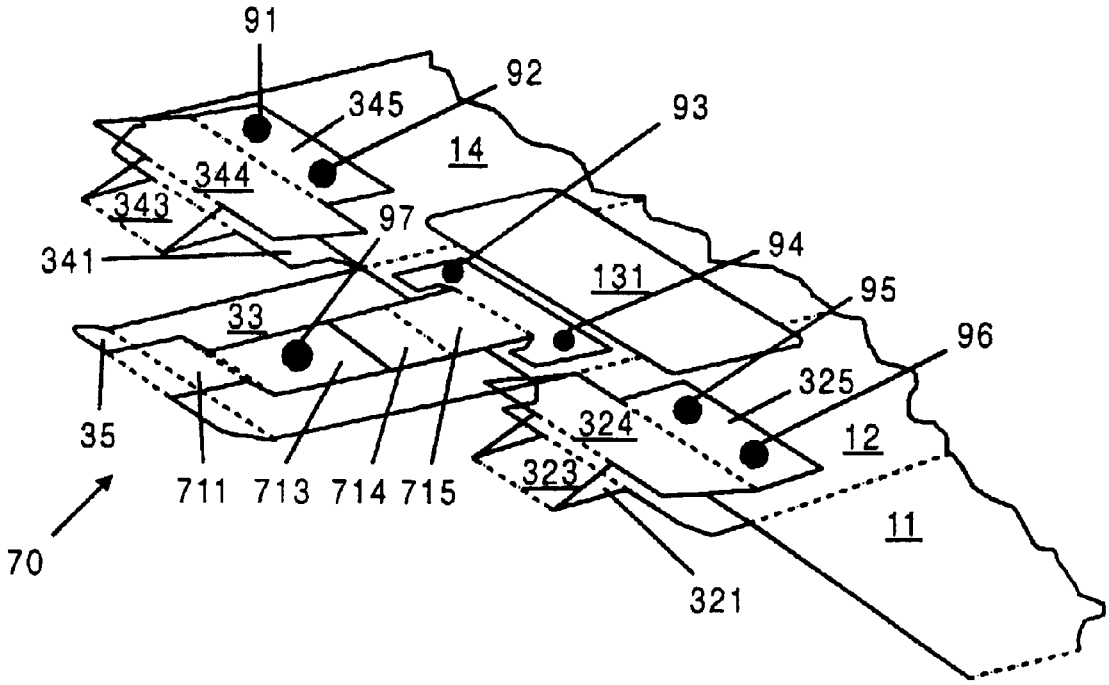
Figure 6:
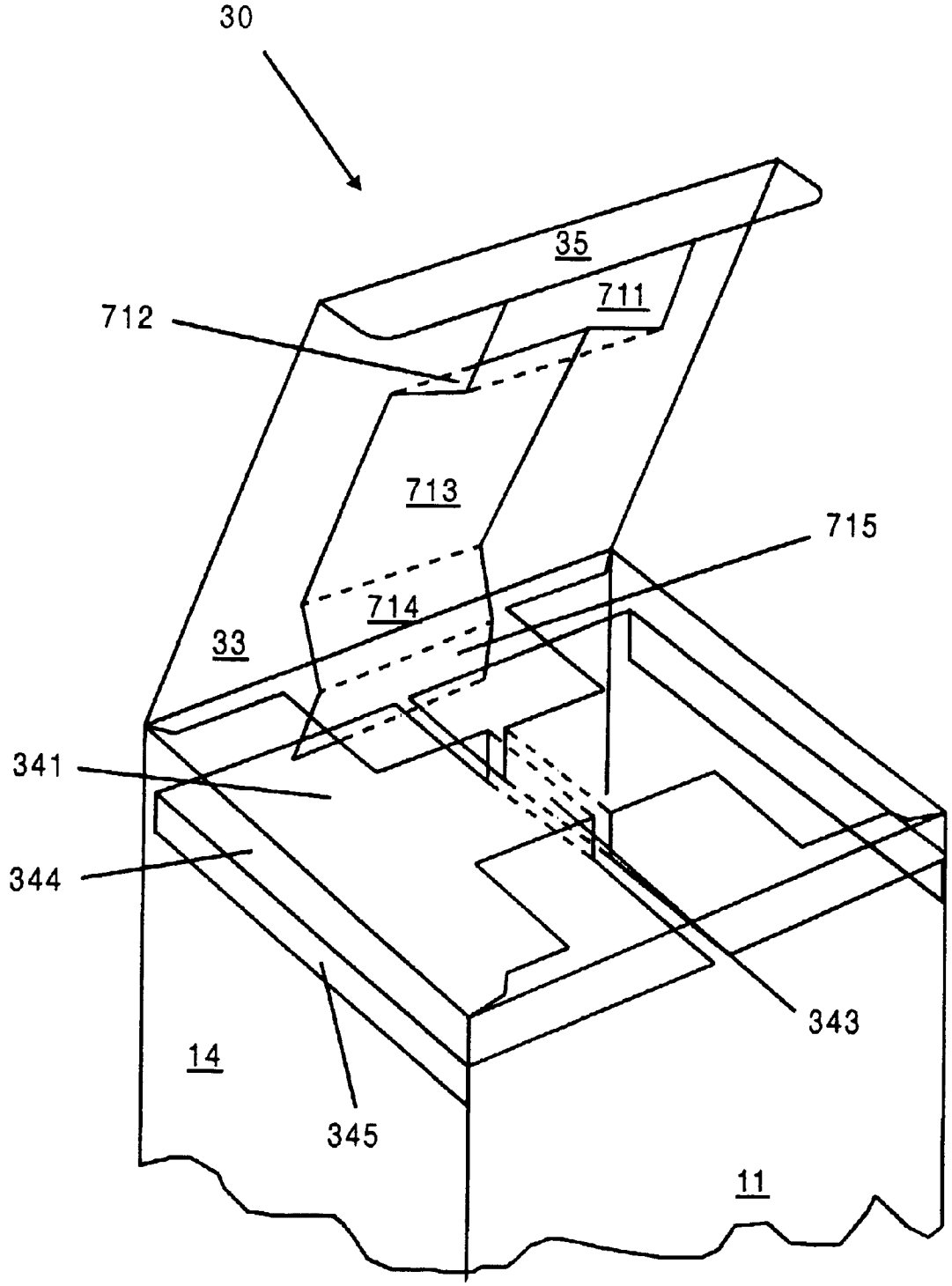
Figure 7:
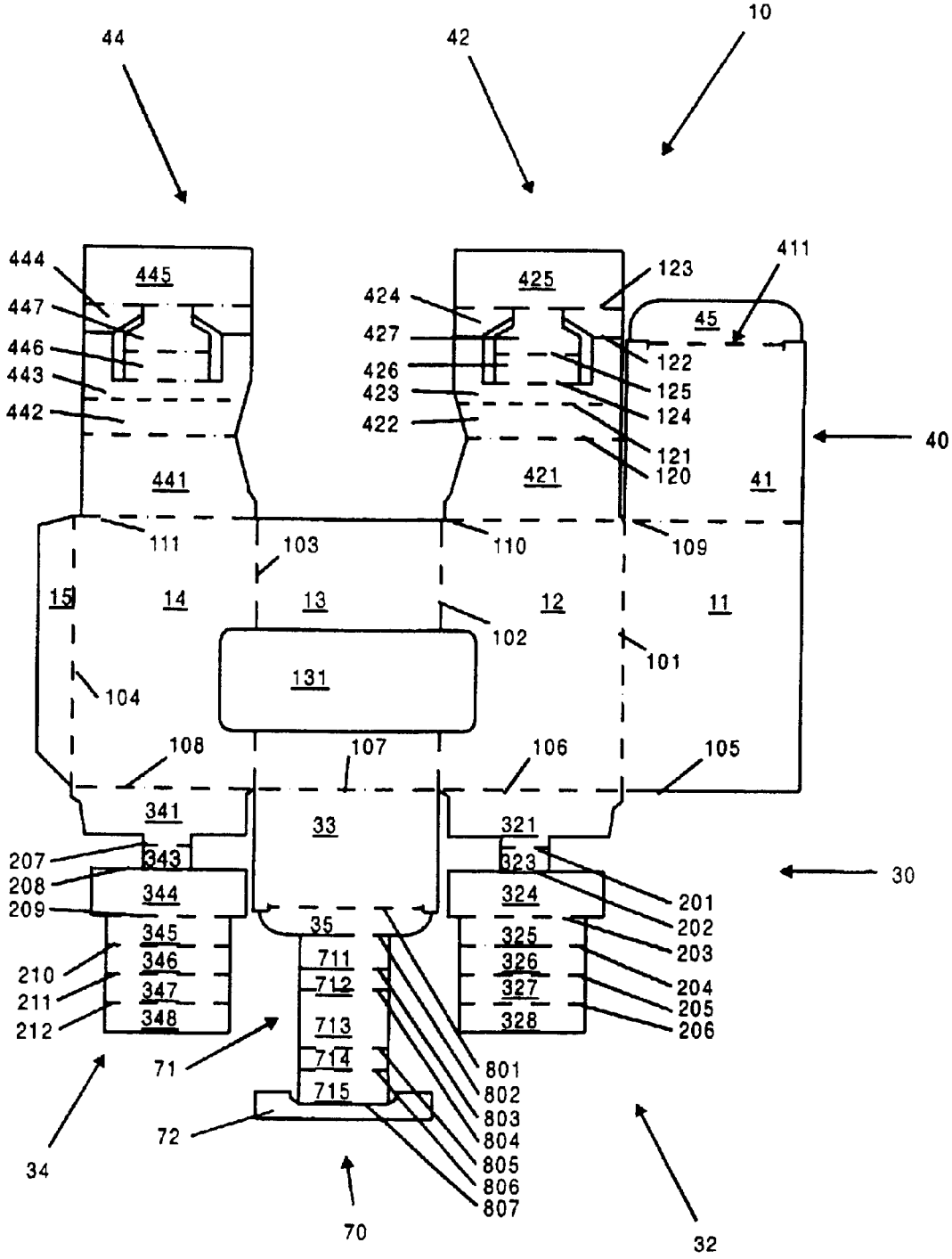
Figure 8:
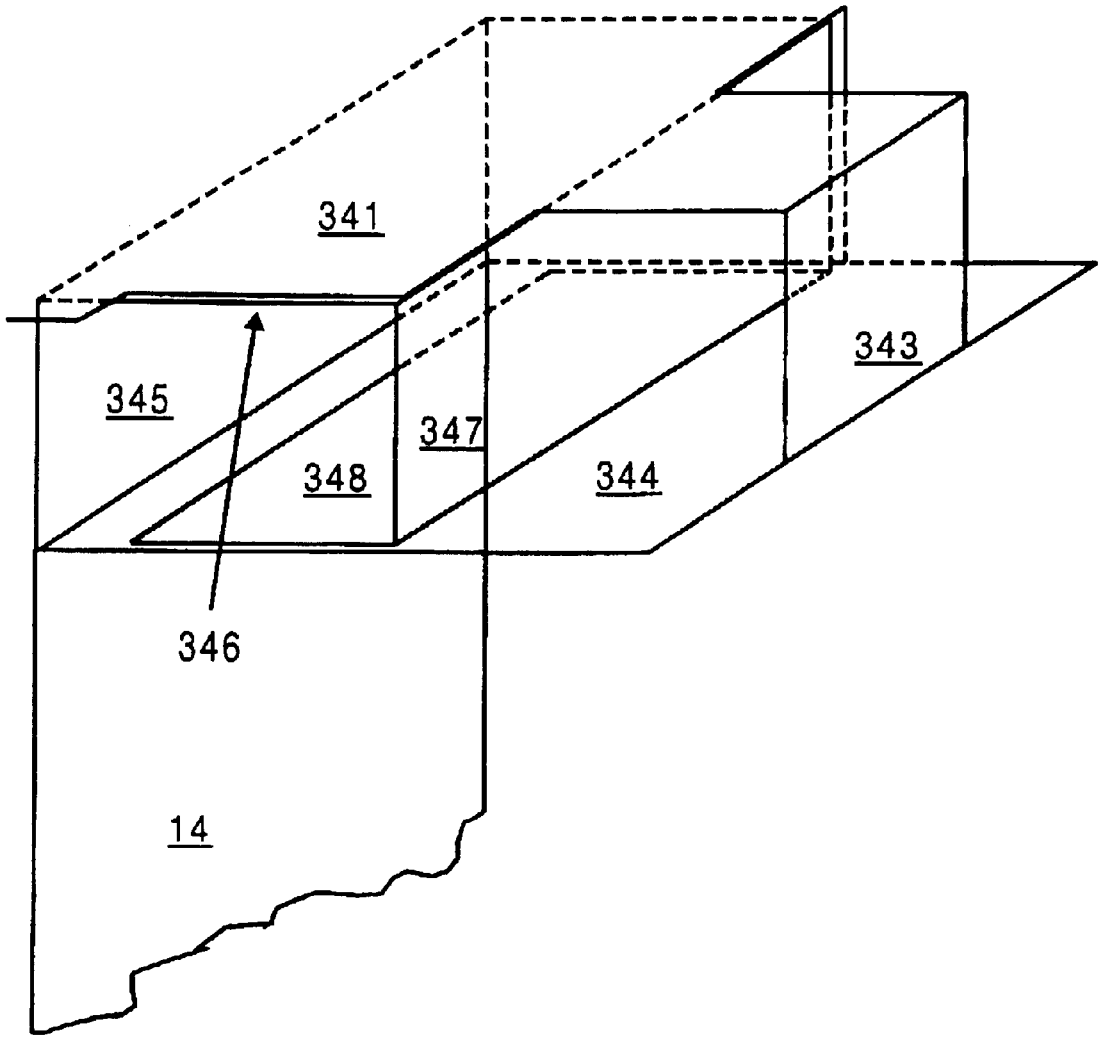
Figure 9:
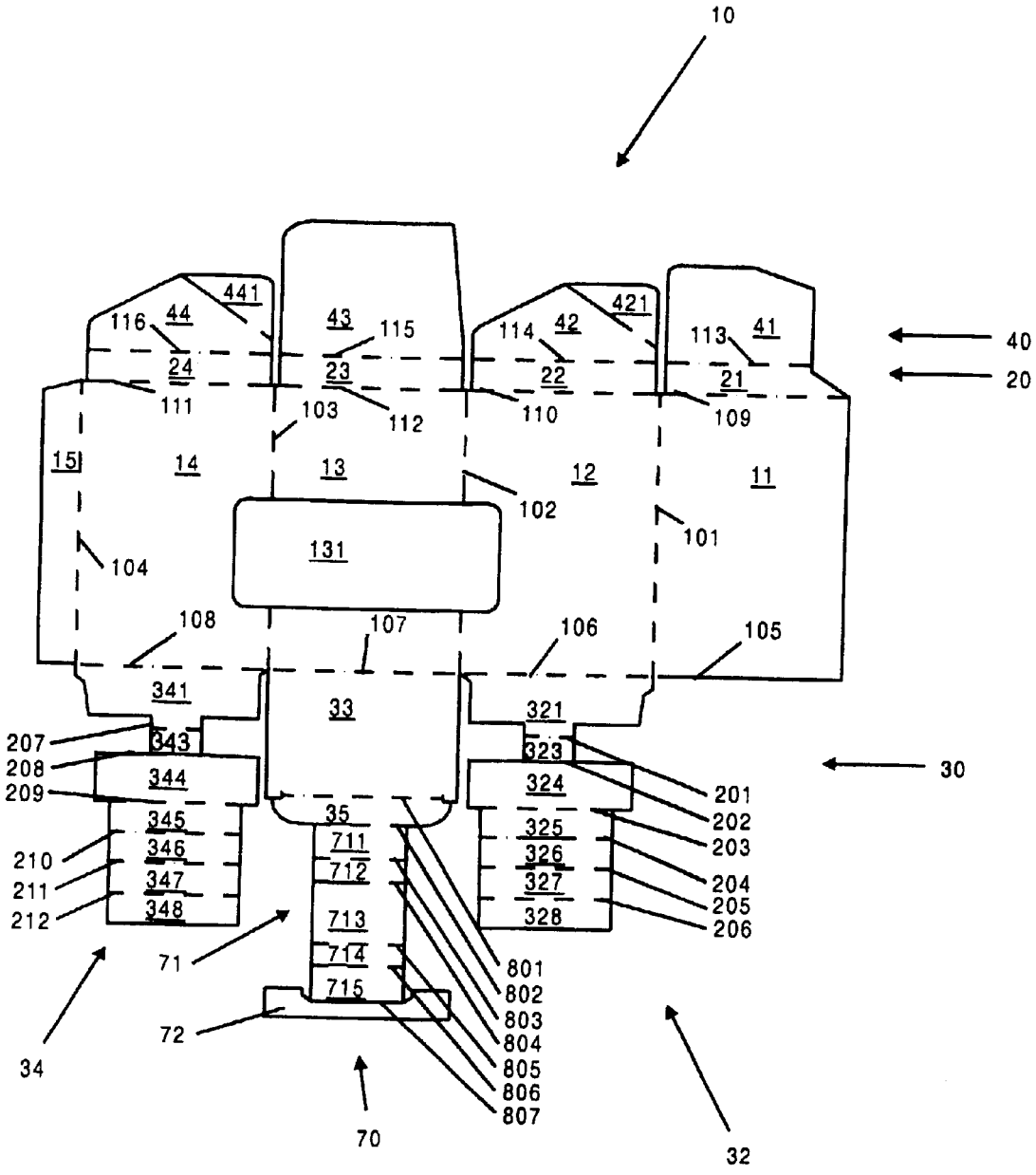
Figure 10:
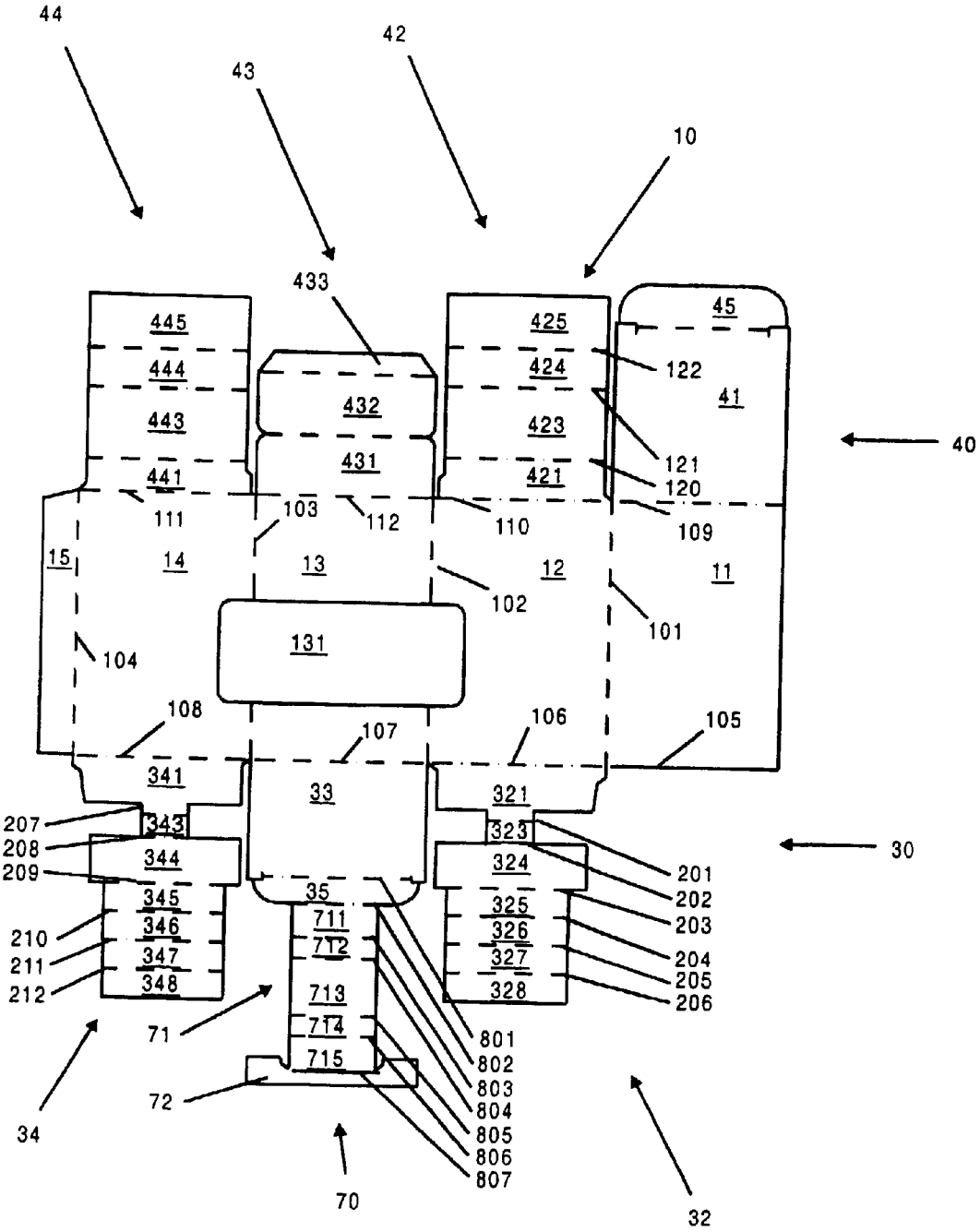
Figure 11:
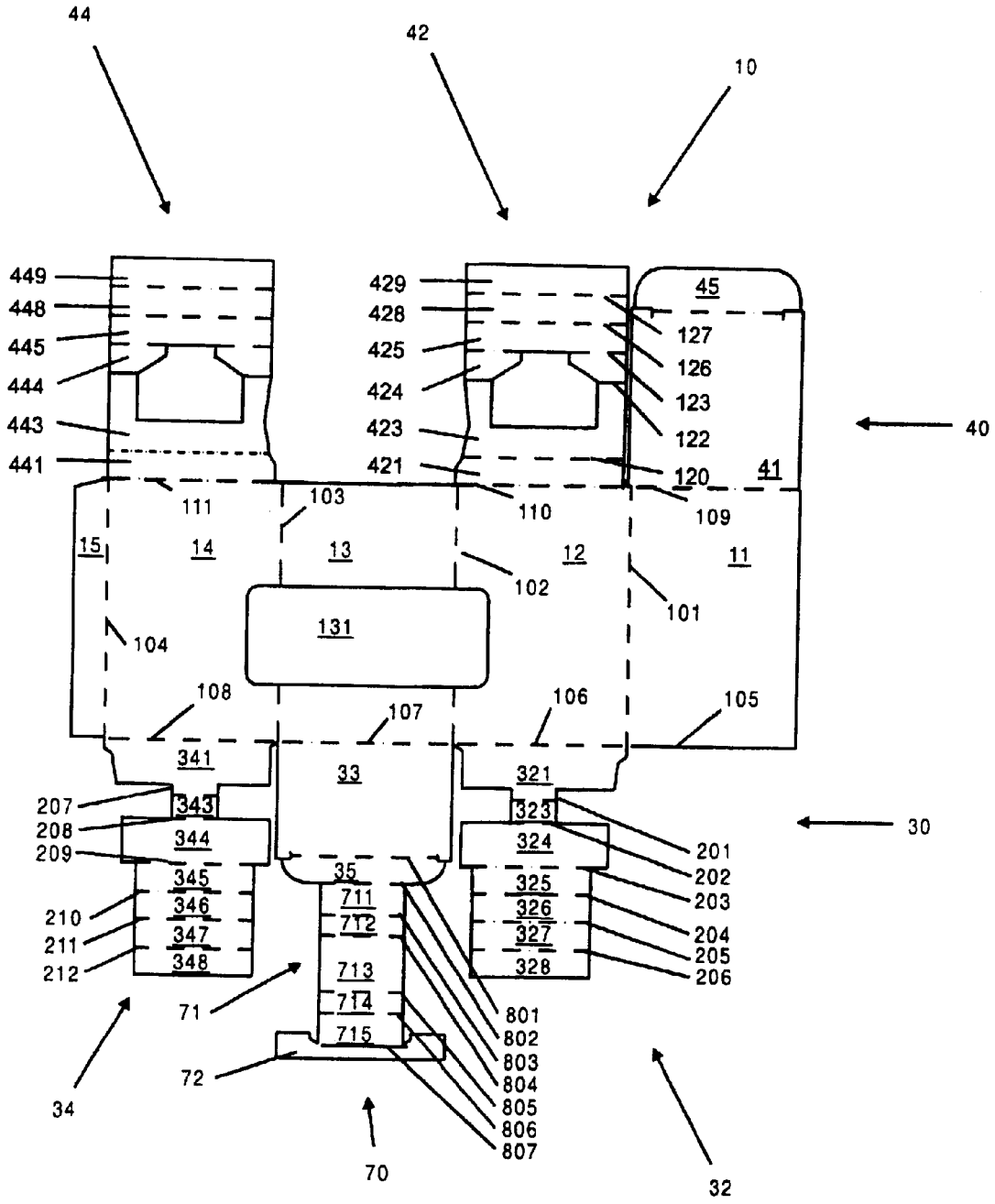

Particularly advantageous configurations of the folding box together with the punched blank will be explained in more detail with reference to the figures described hereinbelow, without there being any intention of restricting the invention unnecessarily. In the figures:

FIG. 1 shows the flattened-out, non-adhesively-bonded punched blank of an advantageously configured folding box, FIG. 2 shows the operation of assembling the flaps in the base region within the folding box according to FIG. 1, FIG. 3 shows the base region of a folding box according to FIG. 1 just before completion, FIG. 4 shows the flattened-out, non-adhesively-bonded punched blank of a further advantageously configured folding box, FIG. 5 shows the operation of assembling the flaps in the base region within the folding box according to FIG. 4, FIG. 6 shows the base region of a folding box according to FIG. 4 just before completion, FIG. 7 shows the flattened-out, non-adhesively-bonded punched blank of a further advantageously configured folding box, FIG. 8 shows the operation of assembling one of the flaps in the base region within the folding box according to FIG. 7, FIG. 9 shows the flattened-out, non-adhesively-bonded punched blank of a further advantageously configured folding box, FIG. 10 shows the flattened-out, non-adhesively-bonded punched blank of a further advantageously configured folding box, FIG. 11 shows the flattened-out, non-adhesively-bonded punched blank of a further advantageously configured folding box.

Figure 12:
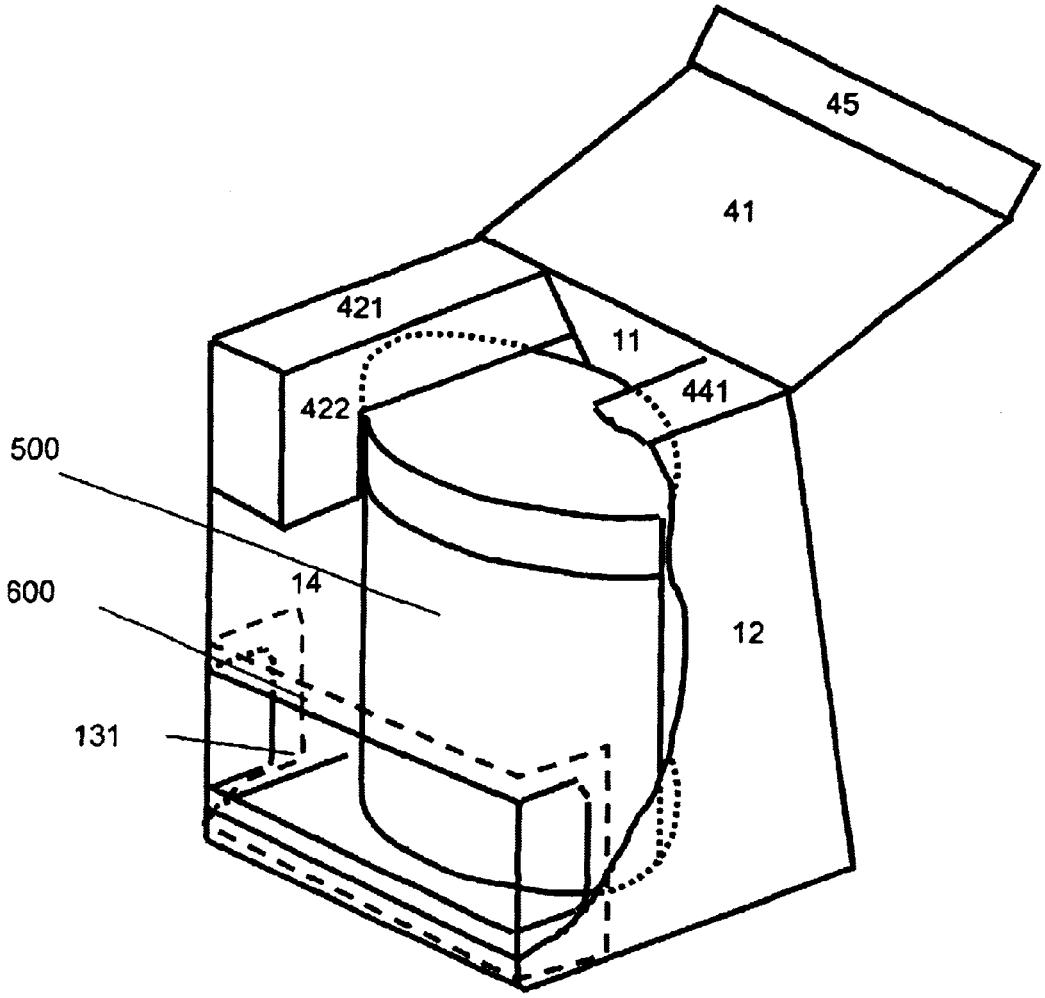

FIG. 12 shows the folded box of the present invention with a tapered pack casing, a transparent film covering cutout 131 and containing a jar with a screw closure.

FIG. 1 illustrates the folding blank 10 of the folding box 1, said blank comprising a single-piece cardboard. The folding blank 10 may consist of paperboard, cardboard or some other suitable material. The body of the erected folding box 1 is formed by the front side wall 13, the rear side wall 11, the right-hand side wall 12, which connects the front side wall 13 and the rear side wall 11, and the left-hand side wall 14, a flap 15 being articulated laterally on the left-hand side wall 14, and being adhesively bonded to the rear side wall 11, for the non-releasable closure of the body.

All the side walls 11, 12, 13, 14 are rectangular and are preferably of the same dimensions, with the result that, once erected, the folding box 1 has a square base surface. The flap 15 tapers slightly trapezoidal in the direction of its free end and is wide enough for reliable adhesive bonding to the rear side wall 11 to be possible. The flap 15 extends in this case—this being the maximum space—over the entire length of the side wall 14.

The individual side walls 11, 12, 13, 14 and the flap 15 are connected to one another in a row via corresponding folding lines 101, 102, 103, 104.

In the prominent embodiment of the folding box 1 which is shown here, provided in the front side wall 13 is a cutout 131 which extends into the adjacent side walls 12, 14 and may be covered by a transparent film, which is preferably adhesively bonded correspondingly in the folding-box interior.

Articulated in the base region 30, on the side wall 13, is a base part 33 provided with an insertion flap 35 which engages in the pack casing. Articulated centrally on the insertion flap 35, via the folding line 801, is an extension 70 which forms an inner base and comprises an inner-base flap 71, which is articulated on the insertion flap 35, and an adhesive flap 72, which is articulated on the inner-base flap. With the folding box 1 in the completed state, the adhesive flap 72 is adhesively bonded to the side wall 11.

The base part 33 is preferably of a size which corresponds to the cross-sectional surface area of the pack casing of the folding box 1, and the insertion flap 35 is rectangular, the free-standing corners being rounded.

In the advantageous embodiment of the inner-base flap 71 which is shown here, provided in said inner-base flap are four parallel folding lines 802, 803, 804, 805 which divide the inner-base flap 71 into five individual sections 711, 712, 713, 714, 715, the resulting central section 713 of the inner-base flap 71 preferably being adhesively bonded to the base part 33 in order to increase the stability of the base part 33 further. In this way, the two sections 711 and 715 form the inner base. The length of the central section 713 of the inner-base flap 71 by which said section is adhesively bonded to the base part determines the size of the bearing surface by which the inner base is smaller than the surface area of the base part 33.

The height by which the inner base is offset to the inside of the box can be gathered from the height of the sections 712 and 714 which, accordingly, should, as far as possible, be of the same height.

The sections 711, 712, 713, 714, 715 are essentially rectangular, the inner-base flap 71 being narrower than the base part 33.

The adhesive flap 72 extends over the entire width of the base part 33 in order thus to provide an optimum adhesive-bonding surface. In order to increase this further, the adhesive flap 72 encloses the last section 715 of the inner-base flap 71 to a slight extent.

Connected in an articulated manner, in the base region 30, in each case to the two side walls 12, 14 of the pack casing which are adjacent to the base part 33 is a flap 32, 34, said flaps having three folding lines 201, 202, 203, 207, 208, 209 which run parallel to the connection border on the pack casing and subdivide the flap 32 and the flap 34, as seen from the connection border, into a first spacer crosspiece 321, 341, into a supporting strip 323, 343, into a second spacer crosspiece 324, 344 and into an adhesive flap 325, 345, the adhesive flap 325, 345 being adhesively bonded to the inside of the pack casing such that the supporting strip 323, 343 and the second spacer crosspiece 324, 344 are aligned essentially at right angles to one another.

Since the deformable flaps 32 and 34, as is also shown here, are preferably of identical configuration, the description of the flaps 32 and 34 will be restricted to the flap 32.

The two spacer crosspieces 321, 324 are preferably of the same, or of at least more or less the same, width.

The first spacer crosspiece 321, the supporting strip 323, the second spacer crosspiece 324 and the adhesive flap 325 are essentially rectangular. For accommodating the insertion flap 35, however, clearances may be provided on the corresponding sides of the spacer crosspiece 321, of the supporting strip 323, of the spacer crosspiece 324 and of the adhesive flap 325.

Rather than extending over the entire width, the adhesive flap 325 has a cutaway portion, which prevents parts of the cutout 131 from being covered by way of the adhesive bonding, and which is selected such that the largest possible adhesive surface is achieved.

Finally, spots of adhesive 91, 92, 93, 94, 95, 96 are indicated on the side walls 12, 13, 14, these spots of adhesive securing the adhesive flaps 325 and 345 as well as the adhesive flap 72.

Articulated on the rear wall 11, at the folding line 109, is a rectangular lid part 41 which terminates, via the folding line 411, in a insertion flap 45 which engages in the pack casing. The lid part 41 in conjunction with the insertion flap 45 essentially form the closure 40 of the folding box 1. The lid part 41 is therefore preferably of a size which corresponds to the cross-sectional surface area of the pack casing of the folding box 1, and the insertion flap 45 is rectangular, the free-standing corners being rounded.

In each case one deformable flap 42, 44 is connected in an articulated manner, via the folding lines 110 and 111, to the two side walls 12 and 14 of the pack casing which are adjacent to the lid part 41.

Since the deformable flaps 42 and 44, as is also shown here, are preferably of identical configurations, the description of the flaps 42 and 44 will be restricted to the flap 42.

The deformable flap 42 is divided up essentially into five individual sections, to be precise, starting from the folding line 110, into a first spacer crosspiece 421, into a crosspiece 422, into a supporting strip 423, into a second spacer crosspiece 424 and into an adhesive flap 425. A total of four folding lines 120, 121, 122, 123 which are arranged parallel to the pack border are provided between the five sections comprising the spacer crosspiece 421, crosspiece 422, supporting strip 423, spacer crosspiece 424 and adhesive flap 425.

The first spacer crosspiece 421, the crosspiece 422, the supporting strip 423, the second spacer crosspiece 424 and the adhesive flap 425 are essentially rectangular. For accommodating the insertion flap 425, however, clearances may be provided on the corresponding sides of the spacer crosspiece 421, of the crosspiece 422, of the supporting strip 423, of the spacer crosspiece 424 and of the adhesive flap 425.

In the exemplary embodiment illustrated, the sum of the width of the crosspiece 422 and of the second spacer crosspiece 424 is equal to the width of the first spacer crosspiece 421.

It is also possible for the crosspiece 422 to be dispensed with, in which case the width of the first spacer crosspiece 421 is equal to that of the second spacer crosspiece 424.

For stabilizing the folding box 1, the first spacer crosspiece 421 and the crosspiece 422 may be adhesively bonded to one another.

The adhesive flap 425 is adhesively bonded to the inside of the pack casing of the folding box 1 such that the supporting strip 423 and the second spacer crosspiece 424 are aligned essentially at right angles to one another.

Together with the supporting strip 443, which is aligned in parallel once the flap 44 has been folded, this forms a surface which fixes the contents of the folding box 1 in position, with result that any movement of the product within the box 1 is ruled out.

In the preferred embodiment of the folding box 1 which is shown here, the two flaps 42 and 44 have cutouts additionally provided for accommodating the product, to be precise in the supporting strip 43 and in the second spacer crosspiece 424 and also in the supporting strip 443 and in the second spacer crosspiece 444.

The cutout is rectangular in the region of the supporting strip 423, whereas it then runs trapezoidally in the spacer crosspiece 424. The rectilinear part of the cutout in the supporting strip 424 supports the product, while the trapezoidal region engages around the product in the lateral region. In this case, the trapezoidal region of the cutout ends such that, with the flap 42 folded, a spacing remains between the cutout and the side wall 12. This makes it possible to engage around a lid of a product which has a smaller diameter than the container of the product, and thus to fix the entire product in position.

The cutout preferably does not extend over the entire surface area; rather, it is also possible to leave behind, within the cutout, a rectangular connecting crosspiece 426, which is connected to the supporting strip 423 via the folding line 424, and an adhesive extension 427, which is linked to the rectangular connecting crosspiece 426 via the folding line 125 and to the adhesive flap 425 via the folding line 123. The adhesive extension 427, which is trapezoidal in particular, the trapezium being extended as far as the adhesive flap 425 by a rectangle on its narrow side, is adhesively bonded to the adhesive flap 425. The connecting crosspiece 426 supports, and also fixes, the product within the box 1. Overall, the reduced amount of cutting out increases the overall stability of the folded flap 42.

FIG. 2 shows the operation of assembling the flaps 32, 34 in the base region 30 within the folding box according to FIG. 1.

For this purpose, the flaps 32, 34 are folded up in the direction of the folding-box interior and the two adhesive flaps 325 and 345 are pressed onto the previously applied spots of adhesive 91, 92, 95, 96, to produce a fixed connection.

If the flaps 32 and 34 are folded over through 900 in relation to the body of the folding box 1, the supporting strips 323 and 343 are aligned parallel to the side wall 12, 14 respectively.

In the same way, the extension 70 is made into its definitive form by the first section 711 of the inner-base flap 71 being folded over through approximately 180°, and by the central section 713 being adhesively bonded by way of a spot of adhesive 97 likewise previously applied to the base part 33 and, finally, by the adhesive flap 72 being adhesively bonded by way of the spots of adhesive 93, 94. If the insertion flap 35 is then moved into a position at right angles to the base part 33, the inner-base flap 71 is erected. The sections 711 and 715 form part of the inner base.

FIG. 3 discloses the base region 30 of a folding box according to FIG. 1 just before completion of the same. The inner-base flap 71 and the adhesive flap 72 have been fastened in the base part 33, as has been explained above, with result that, as the insertion flap 35 is inserted into the body of the folding box 1, the sections 711 and 715 extend into the box interior.

The folded and adhesively bonded flap 34 is aligned at right angles, with result that the first spacer crosspiece 341 is aligned parallel to the base of the folding box 1, the supporting strip 343 of the line parallel to the side wall 14 and the second spacer crosspiece 344 is aligned in the same plane as, and parallel to, the sections 711 and 715. The height of the spacer crosspieces 341 and 344 is selected such that they project into the folding box 1, at most, as far as the inner base flap.

The same applies to the flap 32.

The spacer crosspieces 324, 344 and the sections 711 and 715 form the entire inner base.

FIG. 4 shows a further flattened-out, non-adhesively-bonded folded blank 10 of an advantageously configured folding box 1, said folding blank comprising a single-piece cardboard blank.

The body of the erected folding box 1 is formed by the front side wall 13, the rear side wall 11, the right-hand side wall 12, which connects the front side wall 13 and the rear side wall 11, and the left-hand side wall 14, a flap 15 being articulated laterally on the left-hand side wall 14, and being adhesively bonded to the rear side wall 11, for the non-releasable closure of the body.

The cutout 131 is provided in the front side wall 13.

The lid region 40 of the folding box 1 is identical to that from FIG. 1.

The essential differences from the folding box according to FIG. 1 can be found in the base region 30, to be precise in the flaps 32 and 34.

The flaps 32 and 34 are cut such that, with the folding box 1 in the completed state, the flaps 32, 34 extend over the central section 713 of the inner-base flap 71, said central section butting against the base part 33. This results in a more or less completely closed inner base.

Since, in this case too, the flaps 32 and 34 are of mirror-symmetrical configuration, only the flap 32 will be described, in which what is said also applies to the flap 34.

The flap 32 is interrupted by three folding lines 201, 202, 203 which run parallel to the connection border on the pack casing and subdivide the flap 32, as seen from the connection border, into a first spacer crosspiece 321, into a supporting strip 323, into a second spacer crosspiece 324 and into an adhesive flap 325, the adhesive flap 325 being adhesively bonded to the inside of the pack casing such that the supporting strip 323 and the second spacer crosspiece 324 are aligned essentially at right angles to one another.

For accommodating the insertion flap 35, clearances are provided on the corresponding sides of the spacer crosspiece 321, of the spacer crosspiece 324 and of the adhesive flap 325.

The first spacer crosspiece 321, starting from the pack casing, extends more or less first of all over the entire width of the side wall 12, in order then to merge centrally into a narrower region which follows the supporting strip 323.

The width of the remainder of the spacer crosspiece is selected such that the width plus the height of the section 711 and the height of the section 715 corresponds approximately to the width of the side wall 13 or (in the case preferred here where the dimensions of the side walls are identical) of all of the side walls 11, 12, 13, 14.

At the same time, the width is largely identical to the length of the central section 713 of the inner-base flap.

The height of that region of the spacer crosspiece 321 which extends over the entire width is fixed such that this plus the height of the corresponding region on the spacer crosspiece 341 plus the width of the inner-base flap, in turn, corresponds approximately to the width of the side walls 11, 12, 13, 14.

Overall, the spacer crosspiece 321 extends into the box center.

The narrow region of the spacer crosspiece 321 is followed by the supporting strip 323, of which the width corresponds to the length of the central section 713 of the inner-base flap. The height of the supporting strip 323 determines how far the inner base is offset into the interior of the folding box 1.

The supporting strip 323 is followed by the second spacer crosspiece 324, which is approximately half the size of the base part 33. The two spacer crosspieces 324 and 344 thus form the inner base, which is at more or less the same size as the base part 33.

The spacer crosspiece 324 is then also followed by the adhesive flap 325, which is adhesively bonded to the side wall 12. A small cutout in the adhesive flap 325 prevents the latter from concealing parts of the cutout 131 following the adhesive bonding.

FIG. 5 shows the operation of assembling the flaps in the base region within the folding box according to FIG. 4.

Apart from the different configuration of the flaps 32 and 34, the assembly operation itself is identical to that which has already been disclosed for FIG. 2.

FIG. 6 shows the base region 30 of a folding box 1 according to FIG. 4 just before completion. Interaction of the individual constituent parts of the folding box 1, in order to achieve a stable and virtually closed inner base in the folding box 1, is particularly clear here.

The two spacer crosspieces 324 and 344 form the inner base. In this case, they cover the sections 711 and 715 of the inner-base flap 71, which in this way support the spacer crosspieces 324 and 344 and thus provide the inner base with further stability.

It is then clear how the inner-base flap 71 encloses the narrow regions of the first spacer crosspieces 321 and 341.

The overall result is an extremely stable inner base, which is also suitable for accommodating relatively large loads without any bowing being observed.

FIG. 7 shows a further flattened-out, non-adhesively-bonded folding blank 10 of an advantageously configured folding box 1, said folding blank comprising a single-piece cardboard blank.

The body of the erected folding box 1 is formed by the front side wall 13, the rear side wall 11, the right-hand side wall 12, which connects the front side wall 13 and the rear side wall 11, and the left-hand side wall 14, a flap 15 being articulated laterally on the left-hand side wall 14, and being adhesively bonded to the rear side wall 11, for the non-releasable closure of the body.

The cutout 131 is provided in the front side wall 13.

The lid region 40 of the folding box 1 is identical to that from FIG. 1.

The essential differences from the folding box according to FIG. 1 can be found in the base region 30, to be precise in the flaps 32 and 34.

In the case of the flaps 32 and 34, three further flaps 326, 327, 328, 346, 347, 348, which are all rectangular in particular, are articulated in each case on the adhesive flap 325, 345 via three folding lines 204, 205, 206, 210, 211, 212 running parallel to the connection border on the pack casing.

In order that crumpling of the cardboard in the region of the flaps 32, 34 is reliably prevented as the folding box 1 is erected and closed, all surfaces which follow the second spacer crosspiece 324, 344 are of somewhat smaller width.

This results in these surfaces being easy to fold in during the production of the folding box 1.

FIG. 8 shows the operation of assembling one of the flaps 32, 34 in the base region 30 within the folding box 1 according to FIG. 7.

The second spacer crosspiece 344 is adhesively bonded to the outermost flap 348 and the first spacer crosspiece 341 is adhesively bonded to the flap 346, which follows the adhesive flap 345.

FIG. 9 shows a further flattened-out, non-adhesively-bonded folding blank 10 of an advantageously configured folding box 1, said folding blank comprising a single-piece cardboard blank.

The body of the erected folding box 1 is formed by the front side wall 13, the rear side wall 11, the right-hand side wall 12, which connects the front side wall 13 and the rear side wall 11, and the left-hand side wall 14, a flap 15 being articulated laterally on the left-hand side wall 14, and being adhesively bonded to the rear side wall 11, for the non-releasable closure of the body.

All the side walls 11, 12, 13, 14 are rectangular and are preferably of the same dimensions, with the result that, once erected, the folding box 1 has a square base surface. The flap 15 tapers slightly trapezoidal in the direction of its free end and is wide enough for reliable adhesive bonding to the rear side wall 11 to be possible. The flap 15 extends in this case—this being the maximum space—over the entire length of the side wall 14.

The individual side walls 11, 12, 13, 14 and the flap 15 are connected to one another in a row via corresponding folding lines 101, 102, 103, 104.

In the prominent embodiment of the folding box 1 which is shown here, provided in the front side wall 13 is a cutout 131 which extends into the adjacent side walls 12, 14 and may be covered by a transparent film, which is preferably adhesively bonded correspondingly in the folding-box interior.

The folding box 1, in the base region 30, is identical to the folding box as is known from FIG. 1. However, an alternative embodiment is realized in the lid region 40.

An intermediate flap 21, 22, 23, 24 is articulated, in each case via a folding line 109, 110, 111, 112, on each of the four side walls, 11, 12, 13, 14 which together form the pack casing of the folding box 1, the intermediate flaps 21, 22, 23, 24 all being of the same height.

Furthermore, the intermediate flaps 21, 22, 23, 24 are preferably all of identical shape; they are particularly preferably rectangular. The height of the intermediate flaps 21, 22, 23, 24 predetermines how far the lid 40 of the folding box 1 is ultimately displaced into the interior of the folding box 1.

The intermediate flaps 21, 22, 23, 24, which are all of the same height, are provided with an adhesive and, for assembling the folding box 1, are folded over in the direction of the box 1 such that the intermediate flaps 21, 22, 23, 24 are adhesively bonded to the interior of the side walls 11, 12, 13, 14.

The height of the intermediate flaps 21, 22, 23, 24 predetermines the depth to which the base is displaced in the direction of the box interior.

A lid flap 41, 42, 43, 44 is articulated, in each case via a folding line 113, 114, 115, 116, on each of the four intermediate flaps 21, 22, 23, 24, in each case two of the lid flaps 41, 42, 43, 44 being adhesively bonded to one another such that the lid 40 automatically closes as the folding box 1 is erected.

The flaps 41, 42, 43, 44 preferably form a lid closure 40 as is known, according to ECMA Code A 6101 or A 6120 (see "THE ECMA CODE of FOLDING CARTON STYLES", published by ECMA (European Carton Makers Association), Reprint January 2000), as a folding-base closure with a fully covering base flap. This closure 40 is erected automatically, as a result of the specific shaping of the lid flaps 41, 42, 43, 44, as the folding box 1 is adhesively bonded. If the folding box 1 is filled with contents, the lid closure 40 cannot be opened from the outside.

For assembling the closure 40, the two adhesive sections 421, 441, which are integrally formed on the flaps 42 and 44, are adhesively bonded to the flap 43 and 41, to be precise the section 441 is adhesively bonded to the flap 43 and the section 421 is adhesively bonded to the flap 41.

As the folding box 1 is erected, the closure 40 closes such that the flap 43 becomes a closing lid for the product which is to be displayed within the folding box 1. The flap 43 is thus preferably more or less the same size as the cross section of the folding box 1.

FIG. 10 shows a further flattened-out, non-adhesively-bonded folding blank 10 of an advantageously configured folding box 1, said folding blank comprising a single-piece cardboard blank.

The folding box 1, in the base region 30, is identical to the folding box as is known from FIG. 1. However, an alternative embodiment is realized in the lid region 40.

Articulated on the rear wall 11, first of all, a rectangular lid part 41 which terminates, via the folding line 411, in an insertion flap 45 which engages in the pack casing.

In each case one deformable flap 42, 44 is connected in an articulated manner, via the folding lines 110 and 111, to the two side walls 12 and 14 of the pack casing which are adjacent to the lid part 41.

The deformable flap 42 is divided up essentially into four individual sections, to be precise, starting from the folding line 110, into a first spacer crosspiece 421, into a supporting strip 423, into a second spacer crosspiece 424 and into an adhesive flap 425. A total of three folding lines 120, 121, 122 which are arranged parallel to the pack border are provided between the four sections comprising the spacer crosspiece 421, supporting strip 423, spacer crosspiece 424 and adhesive flap 425.

The first spacer crosspiece 421, the supporting strip 423, the second spacer crosspiece 424 and the adhesive flap 425 are essentially rectangular.

The adhesive flap 425 is adhesively bonded to the inside of the pack casing of the folding box 1, such that the supporting strip 423 and the second spacer crosspiece 424 are aligned essentially at right angles to one another.

The two spacer crosspieces 421 and 424 are preferably of the same width, but it is also possible for slightly different width to be selected, as a result of which the supporting strip 423 deviates slightly from the parallel alignment in relation to the wall of the pack casing.

A further special feature is constituted by the so-called "crowner" 43. Articulated on the side wall 13, via the folding line 112, is a first surface 431, which is followed by a second surface 432 via the folding line 402. A flap 433 is then articulated via the folding line 403.

The second surface 432 is preferably of identical dimensions to the first surface 431, and should not in any way be selected to be smaller. The crowner 43 is produced by the second surface 432 being folded back through 180°, being provided with an application of adhesive and being pressed onto the first surface 431.

The two preferably rectangular surfaces 431 and 432 serve as an additional surface which may provide information on the product contained therein or an "eye-catcher". The crowner 43 extends vertically from the folding box 1 in order thus to draw more attention to the box 1.

The folding line 403 may be configured as a weakened or predetermined breaking line in order to allow the crowner 43 to be severed easily from the folding box 1 without damaging the latter.

FIG. 11 shows a further flattened-out, non-adhesively-bonded folding blank 10 with an advantageously configured folding box 1 without a crowner, said folding blank comprising a single-piece cardboard blank.

The folding box 1 from FIG. 11 differs from that from FIG. 10 merely by the configuration of the flaps 42 and 44.

According to FIG. 11, the deformable flap 42 is divided up essentially into six individual sections, to be precise, starting from the folding line 110, into a first spacer crosspiece 421, into a supporting strip 423, into a second spacer crosspiece 424, into an adhesive flap 425, into a third spacer crosspiece 428 and into a second adhesive flap 429. A total of five folding lines 120, 122, 123, 126, 127 which are arranged parallel to the pack border are provided between the six sections.

The operation of folding up the deformable flap 42 takes place such that the adhesive flap 425 can be adhesively bonded to the side wall 11, and the second adhesive flap 429 can also be adhesively bonded to the supporting strip 423.

If the flap 42 is folded over through 90° in relation to the body of the folding box 1, the supporting strip 423 is erected parallel to the side wall 11. The double adhesive bonding considerably increases the fixing support of the product and the stiffening of the flap 42.

The cutout is punched out in accordance with the product contour.

In the preferred embodiment of the folding box 1 which is shown here, the two flaps 42 and 44 have cutouts additionally provided for accommodating the product, to be precise in the supporting strip 423 and in the second spacer crosspiece 424 and also in the supporting strip 443 and in the second spacer crosspiece 444.

The cutout is rectangular in the region of the supporting strip 423, whereas it then runs trapezoidally in the spacer crosspiece 424.

The cutout is completed here.

FIG. 12 shows the folded box of the present invention with a tapered pack casing, a transparent film 600 covering cutout 131 and containing a jar 500 with a screw closure.

What is claimed is:

1. A folding box, having a rectangular pack casing with four side walls (11, 12, 13, 14), each having a top end and a base end, and a lid part (41) which is connected to the top end of a first (11) of said four walls and is provided with a first insertion flap (45) and, articulated on the base end (30), on one of the four side walls (11, 12, 13, 14) which form the pack casing, is a base part (33) provided with a second insertion flap (35), there being articulated on the second insertion flap (35) an extension (70) which forms an inner base and at least comprises an inner-base flap (71), which is articulated on the second insertion flap (35) and is divided by four parallel folding lines (802, 803, 804, 805) into five individual sections (711, 712, 713, 714, 715), with a central section (713) which is optionally adhesively bonded to the base part, and an adhesive flap (72), which is articulated on the inner-base flap (71) and, in the completed folding box (1), is adhesively bonded to a second side wall (13), which is located opposite the first side wall (11), which is in contact with the second insertion flap (35).

2. The folding box according to claim 1, wherein the inner-base flap (71) is narrower than the base part (33).

3. The folding box according to claim 2, wherein connected in an articulated manner, to the base end (30), of a third and fourth of said side walls (12, 14) of the pack casing is in each case one flap (32, 34), each of said flaps (32, 34) having three folding lines (201, 202, 203, 207, 208, 209) which run parallel to each other and subdivide each flap (32, 34) into a first spacer crosspiece (321, 341), into a supporting strip (323, 343), into a second spacer crosspiece (324, 344) and into an adhesive flap (325, 345), the adhesive flap (325, 345) being adhesively bonded to the inside of the completed pack casing such that the supporting strip (323, 343) and the second spacer crosspiece (324, 344) are aligned essentially at right angles to one another.

4. The folding box according to claim 3, wherein the flaps (32, 34) of said third and fourth side walls are cut such that, with the folding box (1) in the completed state, each of said flaps (32, 34) extend over the central section (713) of the inner-base flap (71), said central section butting against the base part (33).

5. The folding box according to claim 4, wherein, in the case of the flaps (32, 34) of said third and fourth side walls, three further flaps (326, 327, 328, 346, 347, 348) are articulated in each case on the adhesive flap (325, 345) via three folding lines (204, 205, 206).

6. The folding box according to claim 1, wherein connected in an articulated manner, in the lid region (40), to the third and fourth side walls (12, 14) of the pack casing is in each case one upper flap (42, 44), said upper flaps having three folding lines (120, 122, 123) which run parallel to each other and subdivide the upper flaps (42, 44) into a first spacer crosspiece (421, 441), into a supporting strip (423, 443) into a second spacer crosspiece (424, 444) and into an adhesive flap (425, 445), each adhesive flap (425, 445) being adhesively bonded to the inside of the completed pack casing such that the supporting strips (423, 443) and the second spacer crosspieces (424, 444) are aligned essentially at right angles to one another.

7. The folding box according to claim 6, wherein the supporting strip (423) and the second spacer crosspiece (424) have a cutout which is provided for accommodating a product and is adapted to the shape of the product.

8. The folding box according to claim 6, wherein, in the case of the upper flaps (42, 44), the adhesive flaps (425, 445) are followed in each case by a third spacer crosspiece (428, 448) via a folding line (126), and by a second adhesive flap (429, 449), via a folding line (127).

9. The folding box according to claim 1, wherein at least two of the four side walls (11, 12, 13, 14) which form the pack casing taper slightly in the direction of the lid region (40) starting from the base region (30).

10. The folding box according to claim 1, wherein provided in the second side wall (13) is a cutout (131) which extends into the adjacent side walls (12, 14) and is covered by a transparent film.

11. The folding box according to claim 1, containing a jar with a screw closure positioned thereon.

12. A punched blank for producing a reclosable, cuboidal folding box (1) with a front side wall (13), a rear side wall (11), a right-hand side wall (12), which connects the front side wall (13) and the rear side wall (11), and a left-hand side wall (14) having a side wall flap (15) articulated thereon, a base closure (30), which is formed by three base-closure tabs (32, 33, 34), and a top closure (40), which is formed by three top closure tabs (41, 42, 44), the front side wall (13), the rear side wall (11), the right-hand side wall (12), which connects the front side wall (131) and the rear side wall (11), and the left-hand side wall (14) as well as the side wall flap (15), each linked to one another via folding lines (101, 102, 103, 104), are arranged rectilinearly one behind the other in a row, there being articulated on the rear side wall (11), via the a folding line (109), a rectangular lid part (41) which terminates, via a folding line (411), in a first insertion flap (45), the right-hand side wall (12) having articulated on one end thereof an upper flap (42) via a folding line (110) and, on the opposite end, a base flap (32) via a folding line (106), the upper flap (42) of the right-hand side wall being divided up into five individual sections, comprising a first spacer cross-piece (421), a first crosspiece (422), a supporting strip (423), a second spacer cross-piece (424) and an adhesive flap (425), between which a total of four folding lines (120, 121, 122, 123) arranged parallel to each other are provided, the base flap (32) of the right-hand side wall being subdivided by three folding lines (201, 202, 203) running parallel to each other, into a first spacer crosspiece (321), a supporting strip (323), a second spacer crosspiece (324) and an adhesive flap (325), and wherein, articulated on the front side wall (13), in which there is optionally provided a cutout (131) which extends into adjacent side walls (12, 14), is a base part (33) provided with a second insertion flap (35), there being articulated centrally on the second insertion flap (35), via a folding line (801), an extension (70) which comprises an inner-base flap (71), which is articulated on the second insertion flap (35) and in which there are provided four parallel folding lines (802, 803, 804, 805) which divide the inner-base flap (71) into five individual sections (711, 712, 713, 714, 715), and an adhesive flap (72), which is articulated on the inner-base flap, the left-hand side wall (14) also having articulated thereon on one end an upper flap (44) of the left-hand side wall via a folding line (111) and, on the opposite end, a base flap (34) via a folding line (108), the upper flap (44) being divided up into five individual sections, comprising a first spacer crosspiece (441), a crosspiece (442), a supporting strip (443), a second spacer crosspiece (444) and an adhesive flap (445) between which a total of four folding lines which are arranged parallel to each other are provided, the base flap (34) of the left-hand side wall being subdivided by three folding lines (207, 208, 209) running parallel to each other into a first spacer crosspiece (341), into a supporting strip (343), into a second spacer crosspiece (344) and into an adhesive flap (345).

* * * * *